US007207661B2

(12) United States Patent
Chou et al.

(10) Patent No.: US 7,207,661 B2
(45) Date of Patent: Apr. 24, 2007

(54) INK-JET PRINT HEAD WITH A CHAMBER SIDEWALL HEATING MECHANISM AND A METHOD FOR FABRICATING THE SAME

(75) Inventors: Bruce C. S. Chou, Hsin Chu (TW); Chih-Hsien Yeh, Shou Feng Hsiang (TW); Chingfu Tsou, Hou Li Hsiang (TW); Jer-Wei Chang, Hsin Chu (TW); Chen-Chih Fan, Chu Pei (TW)

(73) Assignee: Ligh Tuning Tech. Inc., Hsinchu (TW)

( * ) Notice: Subject to any disclaimer, the term of this patent is extended or adjusted under 35 U.S.C. 154(b) by 190 days.

(21) Appl. No.: 10/890,121

(22) Filed: Jul. 14, 2004

(65) Prior Publication Data

US 2005/0264615 A1 Dec. 1, 2005

(30) Foreign Application Priority Data

Jul. 17, 2003 (TW) ..... 92119508 A

(51) Int. Cl.
*B41J 2/05* (2006.01)

(52) U.S. Cl. ..... 347/61; 347/56

(58) Field of Classification Search ..... 347/54, 347/56, 61

See application file for complete search history.

(56) References Cited

U.S. PATENT DOCUMENTS 5,682,188 A * 10/1997 Meyer et al. ..... 347/61
6,019,457 A * 2/2000 Silverbrook ..... 347/65
6,561,626 B1 * 5/2003 Min et al. ..... 347/47

FOREIGN PATENT DOCUMENTS

TW 535230 6/1992

* cited by examiner

*Primary Examiner*—An H. Do
(74) *Attorney, Agent, or Firm*—Birch, Stewart, Kolasch & Birch, LLP

(57) ABSTRACT

An ink-jet print head with a chamber sidewall heating mechanism includes a substrate, an insulation layer on the substrate, a main channel penetrating through the substrate, a plurality of V-shaped micro-channels each having a diverging end linking with the main channel and a converging end linking with an ink chamber on the insulation layer, and a nozzle plate with a plurality of orifices formed on the ink chamber. The V-shaped micro-channels are perpendicular to the main channel and parallel to and arranged on the insulation layer. Each chamber sidewall includes a heater structure to evaporate ink in the chamber to form a bubble, which pushes the ink in the chamber to eject from the orifice.

16 Claims, 6 Drawing Sheets

INK-JET PRINT HEAD WITH A CHAMBER SIDEWALL HEATING MECHANISM AND A METHOD FOR FABRICATING THE SAME

This Nonprovisional application claims priority under 35 U.S.C. § 119(a) on Patent Application No(s). 092119508 filed in Taiwan, Republic of China on Jul. 17, 2003, the entire contents of which are hereby incorporated by reference.

BACKGROUND OF THE INVENTION

1. Field of the Invention

The invention relates to an ink-jet print head and a method for fabricating the same, and more particularly to an ink-jet print head with a chamber sidewall heating mechanism for forming bubbles within a chamber to eject an ink drop.

2. Description of the Related Art

Recently, ink-jet printers have been gradually popularized, the cost of the ink-jet printer is gradually decreased, and the printing effect is gradually enhanced. On the other hand, since the cost of the color laser printer is still high, the ink-jet printer plays a more important role in the color printing market.

The core technology of the ink-jet printer mainly resides in that the property of the ink-jet print head, which strongly relates to the printing quality. The ink-jet print heads may be mainly divided into a thermal bubble type and a piezoelectric type according to the principle of ejection. The invention aims at the thermal bubble type ink-jet print head. The main principle of the thermal bubble type ink-jet print head is to utilize at least a heater to evaporate the ink to generate bubbles. Sequentially, the pressure of the bubble ejects the ink drop onto the paper so as to form the desired image.

In the prior art, all the heater structures in the thermal bubble type ink-jet print heads reside on either bottom or top, in parallel to the silicon substrate surface, of the chamber. FIG. 1 shows the partially schematic illustration of the prior art thermal bubble type ink-jet print head. Referring to FIG. 1, the ink-jet print head 100 includes a silicon substrate 101, an insulation layer 102 on the silicon substrate 101, a heating resistor 103 on the insulation layer 102, conductive wires 104 and 105 on the heating resistor 103, and a nozzle plate 106 above the conductive wires 104 and 105. An air chamber is formed between the nozzle plate, the heating resistor, and the sidewall, and the ink may be fed into the chamber through the micro channel (not shown) connecting the chamber and the ink reservoir. Thus, an ink chamber 107 is located above the heating resistor 103. The conductor wires 104 and 105 are applied with a voltage such that the current flows through the heating resistor 103 to heat up the ink above it. When the temperature of the heater gradually increases and is higher than the evaporation point of the ink, the local ink above the heater is thus evaporated to form a gas bubble and gradually the bubble grows larger and larger accompanying the higher and higher heater temperature. Finally, a net pressure due to the growing bubble pushes the residual, non-vaporized ink toward the orifice 108 and out of the orifice to the paper sheet to finish the printing mechanism.

In this prior art, there are several problems needed to be overcome. First, the generally adopted heater material (TaAl) is incompatible with the commercial IC processes, that means the heater fabrication process can not be finished in the commercial IC foundry and extra-cost is increased to define the heater process in a special foundry for this purpose. Furthermore, the micro-channel is manufactured using the thick photoresist technology, which is also incompatible with the commercial IC fabricating processes, and the resolution of the thick photoresist is poor. The geometric shape of the micro-channel relates to the refill of ink and the operation property. Typically, the micro-channel has a very narrow opening connected to the chamber and has a V-shape-like fan-out connected to the main channel (not shown), in which the fabrication tolerance must be strictly controlled. Otherwise, the poor ink-jet printing property may be caused. Besides, the heater residing on the bottom surface of the chamber has the problem that the generated heat may be conducted into the silicon substrate due to the large contact surface area between the heater and the substrate. To solve that problem, a thick thermal isolation layer is generally placed there between the heater and the silicon substrate. This would cause another problem of cross talk between two heaters when the heaters density is increased (the printer resolution increases).

SUMMARY OF THE INVENTION

It is an object of the invention to provide an ink-jet print head with a chamber sidewall heating mechanism and a method for fabricating the same.

Another object of the invention is to provide an ink-jet print head compatible with the IC fabricating processes and a method for fabricating the same.

Still another object of the invention is to provide an ink-jet print head, which has a chamber sidewall heating mechanism, a simple design of V-shaped micro-channels withstanding high tolerance of fabrication, and a simple method for fabricating the same.

To achieve the above-mentioned objects, the invention provides an ink-jet print head with a chamber sidewall heating mechanism. The ink-jet print head includes a substrate, an insulation layer on the substrate, a main channel penetrating through the substrate, a plurality of V-shaped micro-channels each having a diverging end linking with the main channel and a converging end linking with an ink chamber on the insulation layer, and a nozzle plate with a plurality of orifices formed on the ink chamber. The V-shaped micro-channels are perpendicular to the main channel and parallel to and arranged on the insulation layer. Each chamber sidewall includes at least a heater structure to evaporate ink in the chamber to form a bubble, which ejects the ink from the chamber via the orifice.

The invention also provides a method for fabricating an ink-jet print head with a chamber sidewall heating mechanism. The method includes majorly the steps of: providing a SOI (Silicon on insulator) wafer with a sandwich structure, the SOI wafer including, from bottom to top, a first silicon layer, an insulation layer and a second silicon layer; patterning the second silicon layer so as to partially expose the insulation layer and thus forming a plurality of heating units on the insulation layer, wherein each heating unit includes an ink chamber and a V-shaped micro-channel corresponding thereto, and a heater structure formed on the chamber sidewall, each of the V-shaped micro-channels has a converging end and a diverging end, and the converging ends link with the ink chambers; partially etching the exposed insulation layer and the first silicon layer to form a main channel penetrating through the double sides of the SOI wafer, wherein the main channel links with the diverging ends of the V-shaped micro channels; and forming a nozzle plate, which has a plurality of orifices, on the ink chambers such that each of the orifices is above each of the ink chambers and the ink may be ejected from the orifices.

According to the above-mentioned structure and method, the designs of the heaters and the V-shaped micro-channels can be effectively simplified so that the fabricating processes can be simplified and the fabricating cost may be reduced. In addition, the thermal loss may be reduced during the ink ejecting process so that the consumed power of the ink-jet print head may be reduced.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 2:
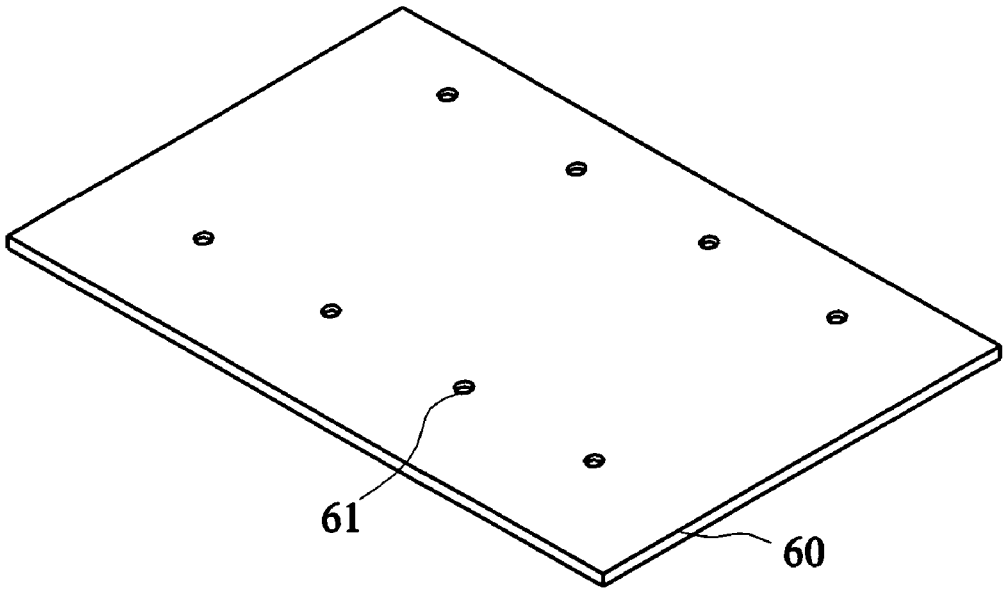
FIG. 2 is a pictorially exploded view showing an ink-jet print head according to a first embodiment of the invention.
Figure 2:
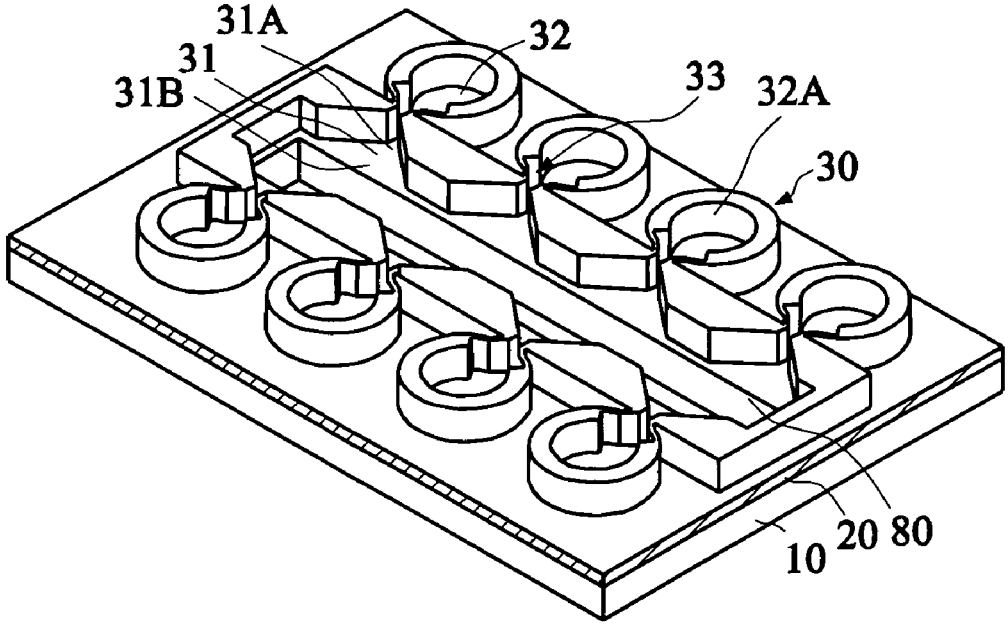

FIG. 2 is a pictorially exploded view showing an ink-jet print head according to a first embodiment of the invention. As shown in FIG. 2, the ink-jet print head with a plurality of heating units of this embodiment is illustrated as an example. The basic structure of the ink-jet print head includes a substrate 10, and insulation layer 20 on the substrate 10, a plurality of heating units 30, a main channel 80, and a nozzle plate 60. The heating unit 30 parallel to the insulation layer 20 includes a V-shaped micro-channel 31, and ink chamber 32 and a heater structure 33. The main channel 80 penetrates through the substrate 10 and the insulation layer 20. Each V-shaped micro-channel 31 has a diverging end 31B and a converging end 31A. The diverging ends 31B link with the main channel 80, and the converging ends 31A link with the ink chambers 32. The nozzle plate 60 has a plurality of orifices 61 located above the ink chambers 32. The inner sidewalls 32A of the ink chambers 32 close to the necks between the micro-channels and the ink chambers are formed with a plurality of heater structures 33 to evaporate the ink in the ink chambers 32 so as to form a plurality of bubbles to push the ink to eject from the ink chambers 32 through the orifices in an ejecting direction substantially perpendicular to a direction from the diverging end 31B to the converging end 31A. Thus, the operation mechanism of the ink-jet print head is completed.

Figure 1:
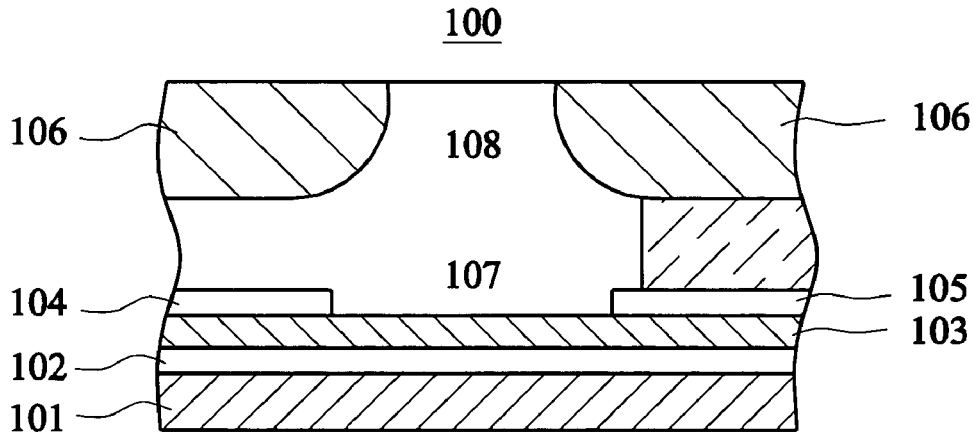
FIG. 1 (Prior Art)
FIG. 1 is a schematic illustration showing an existing thermal bubble type ink-jet print head.
Figure 3:
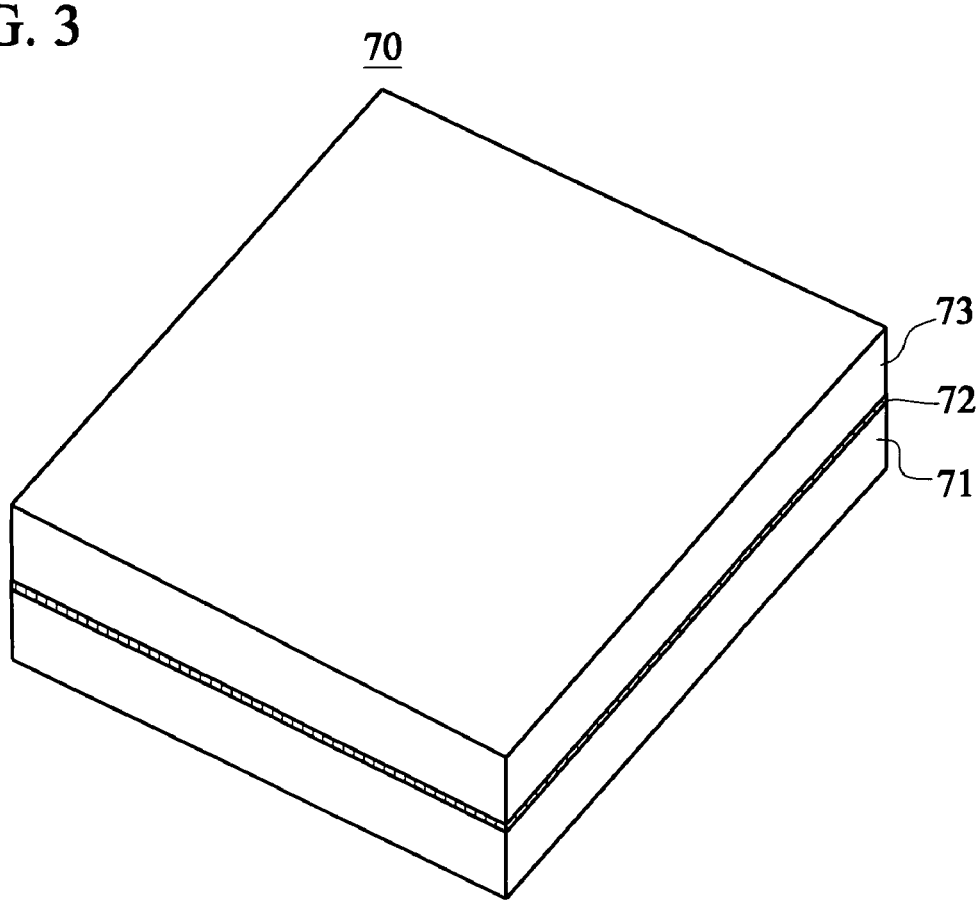
FIG. 3 is a partially pictorial view showing a SOI wafer to be formed into the ink-jet print head of the invention.

FIG. 3 is a partially pictorial view showing a SOI wafer to be formed into the ink-jet print head of the invention. Referring to FIGS. 3 and 2, the invention also provides a method for fabricating an ink-jet print head with a chamber sidewall heating mechanism. The method includes the following steps. First, a SOI (Silicon on insulator) wafer 70 of a sandwich structure is provided. The SOI wafer 70 includes, from bottom to top, a first silicon layer 71, an insulation layer 72, and a second silicon layer 73 of low resistance. The thickness of the second silicon layer 73 ranges from 15 to 30 microns. The second silicon layer 73 is partially removed by way of silicon deep etching technology so that the insulation layer 72 is partially exposed to form a plurality of heating units 30 above the insulation layer 72 utilizing the second silicon layer 73. That is, the ink chambers 32 and their corresponding V-shaped micro-channels 31 are simultaneously formed. The heating units 30 also have a plurality of heater structures 33 formed on a plurality of vertical inner sidewalls 32A of the ink chambers 32. Each V-shaped micro-channel 31 has a converging end 31A and a diverging end 31B. The converging ends 31A link with the ink chambers 32. Then, the exposed insulation layer 72 and the first silicon layer 71 are partially etched to form a main channel 80 penetrating through the insulation layer 72 and the first silicon layer 71. The main channel 80 links with the diverging ends 31B of the V-shaped micro-channels 31. Next, a nozzle plate 60, which is located on the ink chambers 32 and has a plurality of orifices 61, is formed such that one orifice 61 is above each ink chamber 32 and the ink may be ejected from the ink chamber 32 through the orifice 61.

Figure 4:
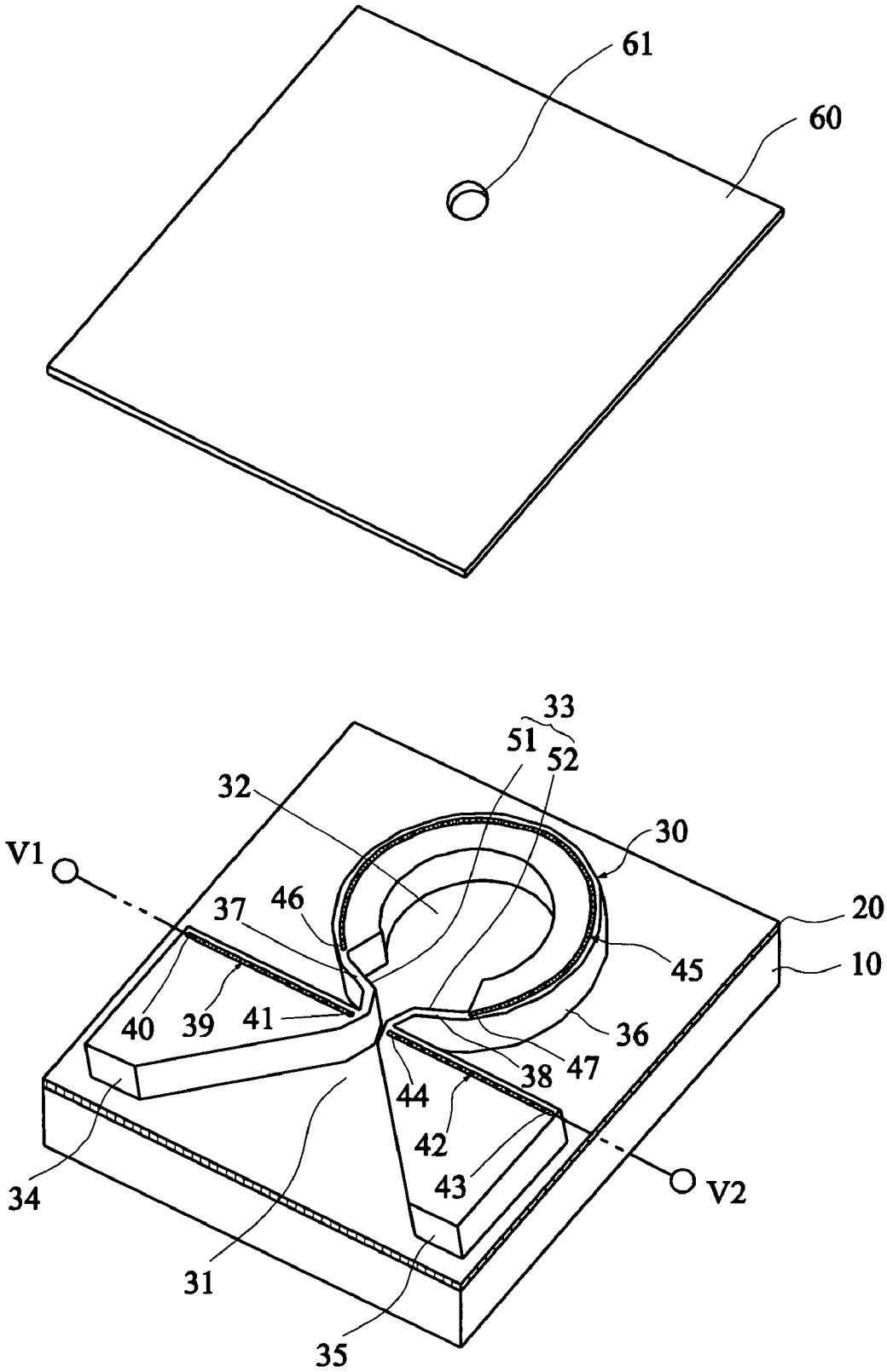
FIG. 4 is a pictorially exploded view showing one heating unit of the ink-jet print head according to the first embodiment of the invention.

FIG. 4 is a pictorially exploded view showing one heating unit of the ink-jet print head according to the first embodiment of the invention. Referring to FIG. 4, the ink-jet print head of this embodiment includes a silicon substrate 10, an insulation layer 20, a heating unit 30 and a nozzle plate 60. The insulation layer 20 is located on the substrate 10. The substrate 10 is usually made of, for example, the silicon material. The insulation layer 20 with good heat isolation property is usually made of, for example, the silicon dioxide material, and the thickness thereof is from 1 to 3 microns. The heating unit 30 includes a V-shaped micro-channel 31 and an ink chamber 32 linking with the V-shaped micro-channel 31. The V-shaped micro-channel 31 linking with the main channel 80 (FIG. 2) is for supplying ink to the ink chamber 32. The ink chamber 32 is in surface contact with a substantially vertical heater structure 33. The heater structure 33 converts the electrical energy into the thermal energy to heat the ink. The nozzle plate 60 covers over the heating unit 30 and is formed with an orifice 61 corresponding to the ink chamber 32, wherein the ink may be ejected from the chamber through the orifice 61.

Each heating unit 30 formed by etching the second silicon layer 73 is composite of single crystal silicon, which includes a first silicon structure 34, a second silicon structure 35, a third silicon structure 36, a first metal wire 39, a second metal wire 42 and a third metal wire 45. The geometric shapes of the first silicon structure 34 and the second silicon structure 35 are constructed of the V-shaped micro-channel 31. The geometric shape of the third silicon structure 36 is constructed of the shape of the ink chamber 32 and the position of the heater structure 33. In this embodiment, the position of the heater structure 33 is located at the connection portion between the ink chamber 32 and the V-shaped micro-channel, and the heater structure 33 has a first heating resistor 37 connected to the first silicon structure 34, and a second heating resistor 38 connected to the second silicon structure 35. The first metal wire 39 is formed above the first silicon structure 34 and has a first end 40 electrically connected to a first voltage V1, and a second end 41 adjacent to the first heating resistor 37. The second metal wire 42 is formed above the second silicon structure 35 and has a first end 43 electrically connected to a second voltage V2, and a second end 44 adjacent to the second heating resistor 38. The third metal wire 45 is formed above the third silicon structure 36 and has a first end 46 adjacent to the first heating resistor 37 and a second end 47 adjacent to the second heating resistor 38. The first and second heating resistors may be made of the low-resistance material of the second silicon layer 73, or the low-resistance silicon material formed by high-temperature diffusing, ion implanting or impurity doping in the second silicon layer 73, or other conductive materials.

As shown in the drawing, the widths of the third silicon structure 36 at the first heating resistor 37 and the second heating resistor 38 are smaller than other in order to reduce the solid thermal conductivity and enhance the heating efficiency. When a voltage difference exists between the first voltage V1 and the second voltage V2, the current may flow from the first metal wire 39 to the third metal wire 45 through the first heating resistor 37, and then to the second metal wire 42 through the second heating resistor 38. Because the resistances of the first to third metal wires are far smaller than those of the first and second heating resistors, the electrical energy is mainly converted into the thermal energy at the first and second heating resistors, and the thermal energy heats the ink through the heating sidewall 51 of the first heating resistor 37 and the heating sidewall 52 of the second heating resistor 38.

Thus, the heater structure 33 of this embodiment includes two heating sidewalls 51 and 52 respectively located at the first heating resistor 37 and the second heating resistor 38. The third silicon structure 36 is substantially a circular ring. Although the ejecting direction of the ink in this embodiment is toward the vertical direction, the ejecting direction of the ink also may be toward the horizontal direction. At this time, only an orifice in parallel to the insulation layer has to be formed on the third silicon structure 36 followed by sealing the ink chamber 32. Meanwhile, the number and position of the heaters are not restricted in the invention. Also, the same heater structure also may be disposed in correspondence with the diameter direction of the ink chamber 32, and the ink ejecting operation may be completed by simultaneously pressing the ink at two directions of the diameter.

The operation condition of the ink-jet print head of FIG. 4 will be illustrated with reference to FIGS. 5 to 8. For the sake of simplicity, the nozzle plate 60 is not illustrated in the drawings. The nozzle plate 60 is composed of a polymer or dry film laminated on the ink chamber 32. Moreover, the orifice 61 can be formed by photolithography or the excimer laser micromachining. This technology can be found in the commonly assigned Taiwan Patent Publication No. 535230.

Figure 5:
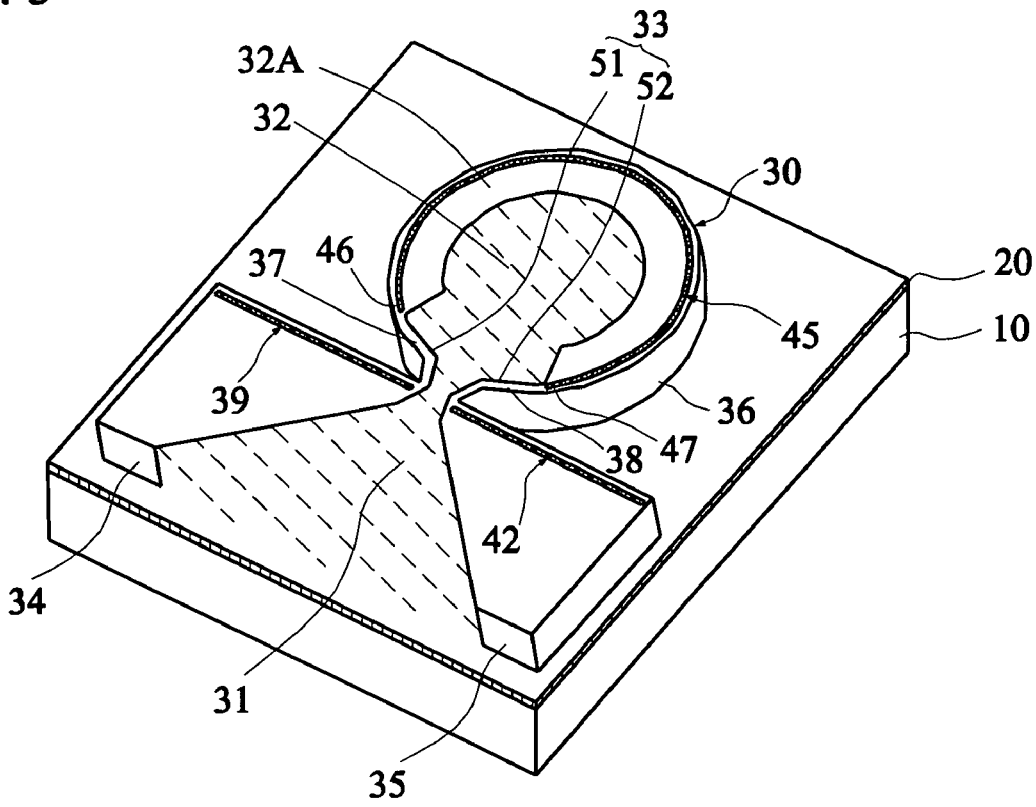
FIG. 5 shows a first operation state of the ink-jet print head of FIG. 4
Figure 6:
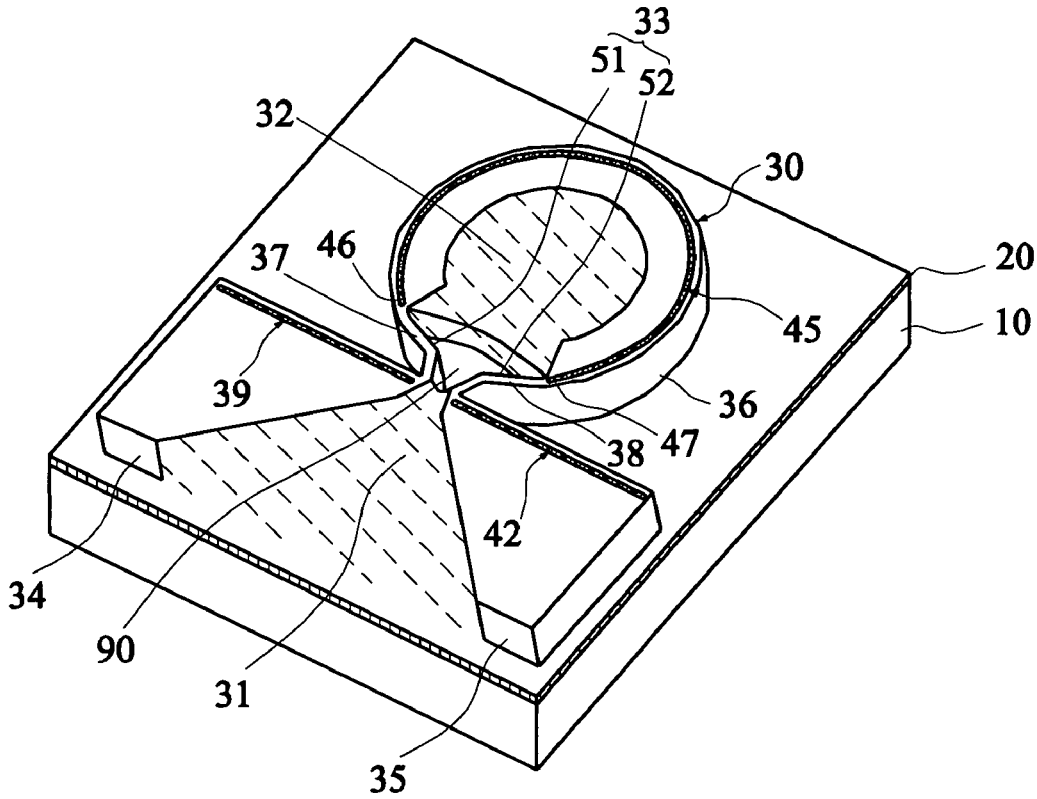
FIG. 6 shows a second operation state of the ink-jet print head of FIG. 4.
Figure 7:
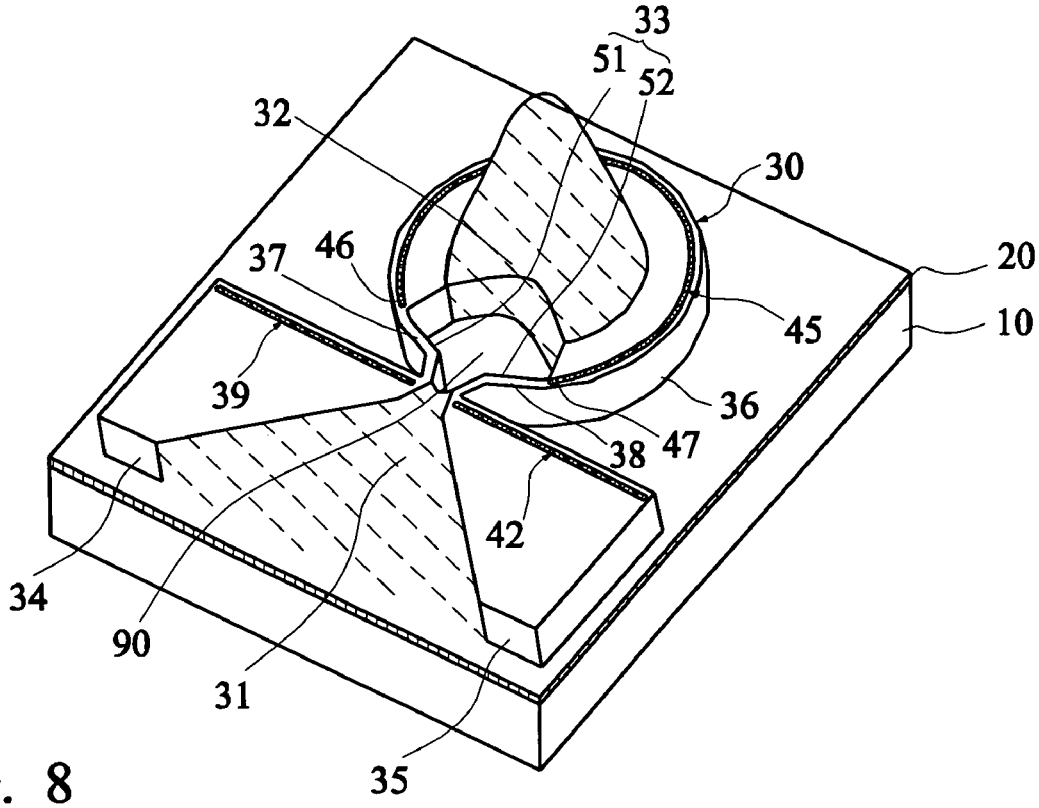
FIG. 7 shows a third operation state of the ink-jet print head of FIG. 4.
Figure 8:
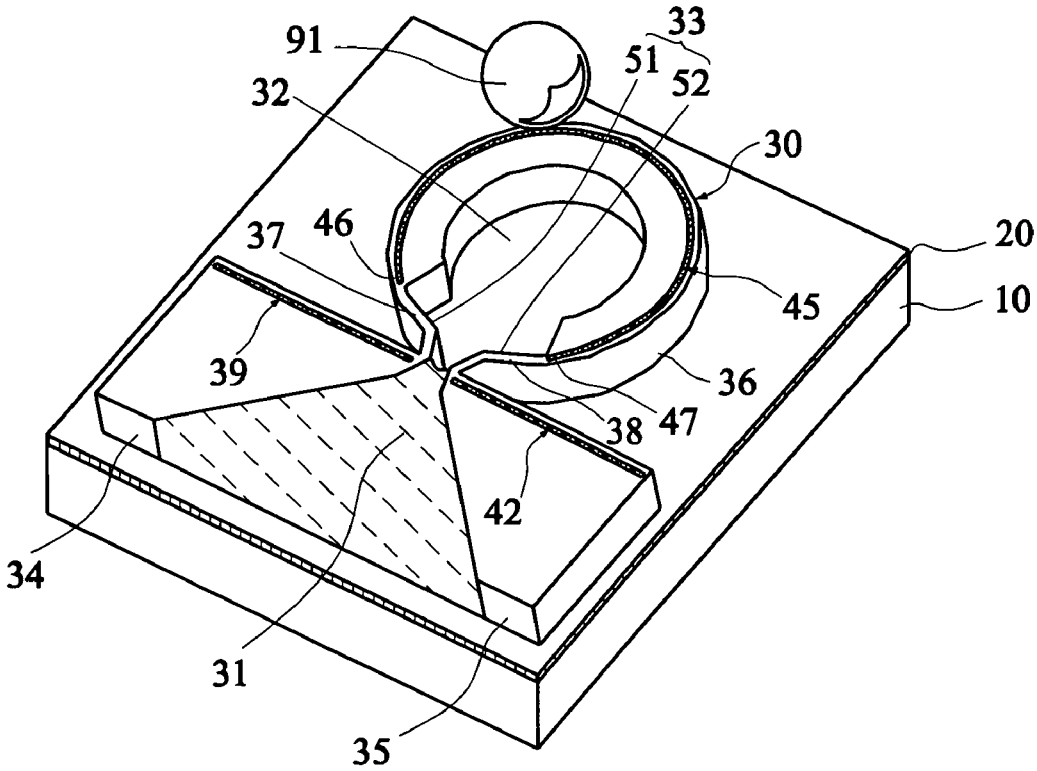
FIG. 8 shows a fourth operation state of the ink-jet print head of FIG. 4.

First, as shown in FIG. 5, the ink flows from the V-shaped micro-channel 31 into the ink chamber 32. Next, as shown in FIG. 6, a voltage difference is applied between the first metal wire 39 and the second metal wire 42 such that the local temperatures of the first heating resistor 37 and the second heating resistor 38 are high in order to heat the ink. The heated ink starts to evaporate and cause a bubble 90 forming a virtual valve, which separates the ink in the ink chamber 32 and the V-shaped micro-channel 31 into two parts and isolates the ink from entering the ink chamber 32 again. Then, as shown in FIG. 7, the bubble 90 continues growing and compresses the volume of the ink in the chamber, and thus pushes the ink upwards and toward the orifice. Next, as shown in FIG. 8, the ink drop 91 is ejected by the high pressure of the bubble 90. When no voltage is applied on the heating resistor, the temperature of the heating unit rapidly drops down due to the heat dissipation of the silicon structure, and thus no thermal bubble will be formed. At this time, the pressure in the ink chamber 32 is lowered, and the ink in the V-shaped micro-channel 31 may be refilled into the ink chamber 32. Then, the condition returns back to that of FIG. 5.

Consequently, the first heating resistor 37 and the second heating resistor 38 are designed to form a virtual valve by the bubble 90 for isolating the ink in the V-shaped micro-channel 31 from entering the ink chamber 32. Hence, the design of the V-shaped micro-channel 31 becomes very simple without worrying about the fabricating error because the virtual valve function for isolating the channel input when the bubble 90 is formed can compensate for the above-mentioned problems. However, one of ordinary skill in the art may easily understand that the function of the invention may be achieved as long as the heater structure 33 is designed such that a bubble 90 may be formed to isolate the ink of the V-shaped micro-channel 31 from the ink of the ink chamber 32.

Figure 9:
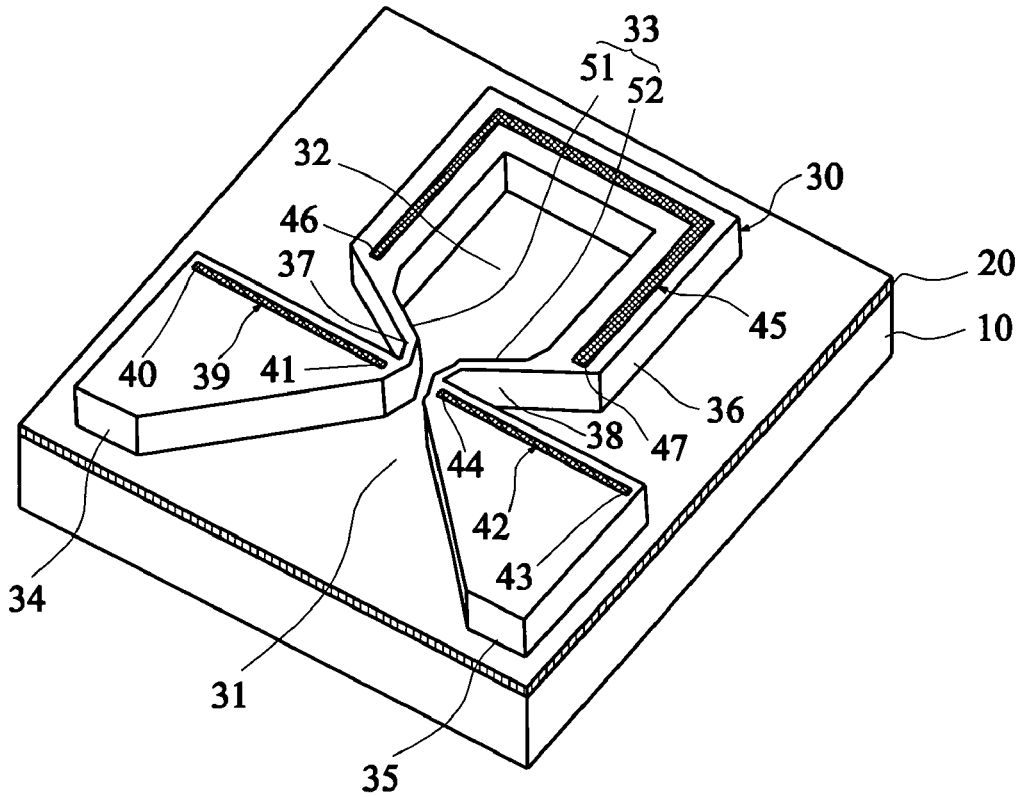
FIG. 9 is a partially pictorial view showing an ink-jet print head according to a second embodiment of the invention.

FIG. 9 is a partially pictorial view showing an ink-jet print head according to a second embodiment of the invention. The structure of the ink-jet print head of the embodiment is similar to that of the first embodiment except for the difference, which is characterized in that the third silicon structure 36 is a substantially rectangular ring. Similarly, the third silicon structure 36 also may be various shapes.

Figure 10:
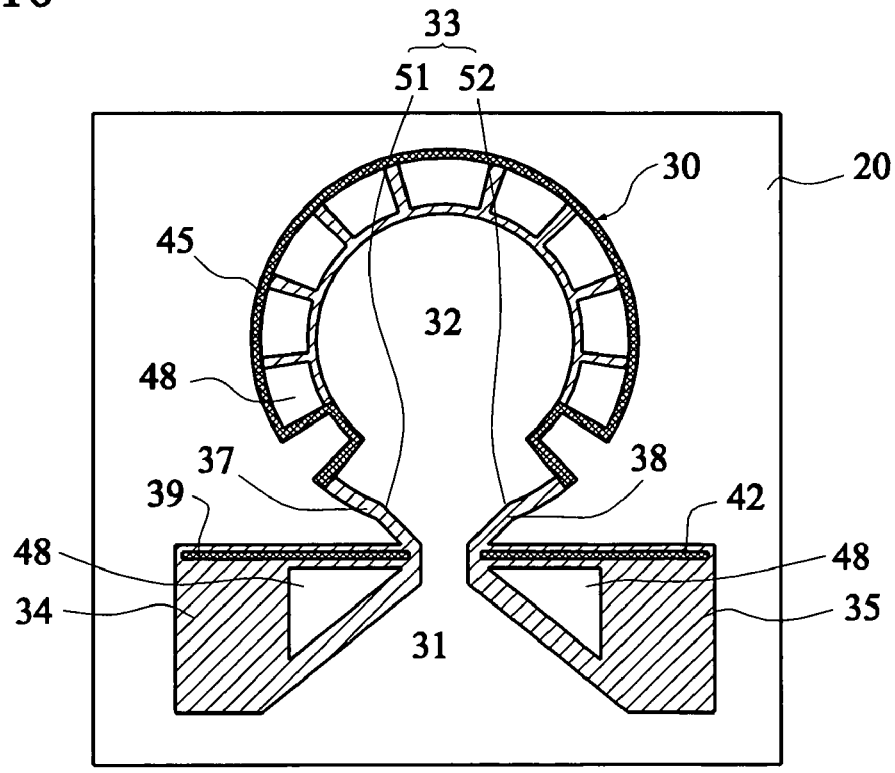
FIG. 10 is a partial top view showing an ink-jet print head according to a third embodiment of the invention.

FIG. 10 is a partial top view showing an ink-jet print head according to a third embodiment of the invention. The structure of the ink-jet print head of the embodiment is similar to that of the first embodiment except for the difference, which is characterized in that the heating unit 30 is formed with a plurality of heat isolation holes 48 for isolating the heat, which comes from the heater structure 33, from being transferred outwards. The so-called "transferred outwards" means that the heat is transferred in directions except for those from the heating sidewalls 51 and 52 to the ink.

In order to effectively reduce the heat loss of the heater structure 33, the heat transfer medium between the heat isolation holes 48 in this embodiment is air or even no medium (vacuum) in addition to the increase in thickness of the insulation layer. Thus, the heat loss of the heater structure 33 in the horizontal direction may be effectively reduced. As for the heat loss in the vertical direction, it may be effectively reduced by decreasing the contact areas between the heating resistors and the insulation layer 20 (FIG. 4) and the nozzle plate 60 (FIG. 4).

The fabricating processes of the ink-jet print head of the invention will be illustrated with reference to FIGS. 2 to 4.

The SOI wafer 70 of the invention has a sandwich structure composed of a first silicon layer 71, an insulation layer 72 and a second silicon layer 73 stacked together. The first silicon layer 71 corresponds to the substrate 10 of FIG. 2, and the insulation layer 72 corresponds to the insulation layer 20 of FIG. 2.

Then, as shown in FIG. 2, a portion of the second silicon layer 73 is etched so that a heating unit 30 is formed on the second silicon layer 73, wherein the heating unit 30 has a V-shaped micro-channel 31 and an ink chamber 32 linking with the V-shaped micro-channel 31. The ink chamber 32 is in surface contact with a substantially vertical heater structure 33, which converts the electrical energy into the thermal energy to heat up the ink.

The shapes of the first silicon structure 34, the second silicon structure 35 and the third silicon structure 36 of the heating unit 30 are formed and defined in the same fabricating process, such that the second silicon structure 35 together with the first silicon structure 34 define the V-shaped micro-channel 31, the third silicon structure 36 has the first heating resistor 37 connected to the first silicon structure 34 and the second heating resistor 38 connected to the second silicon structure 35, and the third silicon structure 36 defines the ink chamber 32.

Alternatively, in the same fabricating process of forming the silicon structure, a plurality of heat isolation holes 48 (FIG. 10) for isolating the heat generated by the heater structure 33 from being transferred outwards may be formed on the first silicon structure 34, the second silicon structure 35 and the third silicon structure 36.

In addition, the first metal wire 39 is formed on the first silicon structure 34, the second metal wire 42 is formed on the second silicon structure 35, and the third metal wire 45 is formed on the third silicon structure 36 except for the first heating resistor 37 and the second heating resistor 38.

Then, the nozzle plate 60 formed with the orifice 61 is placed over the heating unit 30 such that the orifice corresponds to the ink chamber and the ink is ejected from the orifice.

The ink-jet print head of the invention utilizes the chamber sidewall of silicon material to define the heater structure thereon, and thus has a chamber sidewall heating mechanism, which is significantly different from the existing bottom or roof heating mechanism described in prior arts. According to this chamber sidewall heating mechanism, the heat loss may be effectively reduced. This is because that the heat loss in the vertical direction is reduced with the reduction of the cross-sectional area and the heat loss in the horizontal direction is effectively reduced by using the air or vacuum as the heat isolation medium. As for the sidewalls of the first heating resistor 37 and the second heating resistor 38 that are not in contact with the ink, the heat loss may be effectively reduced because they are not in contact with any solid medium in the horizontal direction.

In the case of effectively reducing the heat loss, the power consumed by the ink-jet print head may be effectively reduced and no surplus will affect the operations of other electrical components. In addition, because the ink-jet print head of the invention may be formed using the standard SOI wafer and the ink-heating structure may be formed using very simple and mature fabricating processes, the fabricating processes may be effectively simplified and the fabricating cost may be reduced.

Therefore, the feature of the invention is to use the SOI wafer as the basic material and the silicon deep etching technology such as the ICP (Inductively Coupled Plasma) etching technology. The heater and the V-shaped micro-channel structure which is composite of single crystal silicon are fabricated in the same fabrication step. The resolution of the ICP technology is higher than the thick photoresist technology, and the chamber sidewall heater makes it possible to form an isolation bubble as a virtual valve in the inlet of the V-shaped micro-channel. The bubble can isolate the ink in the ink chamber from the ink outside the ink chamber, prevent the ink in the chamber from flowing back to the V-shaped micro-channel, and thus prevent the heating efficiency from being reduced during the heating process. Hence, the design of the V-shaped micro-channel becomes very simple in this invention without worrying about the fabricating tolerance. Consequently, the ink refilling operation becomes simpler and faster. Meanwhile, an air gap exists between two adjacent heaters, so the cross talk problem is minimized. Meanwhile, it is easy to integrate the associated driving ICs and heaters and the definition of the V-shaped micro-channels and chambers directly on the SOI wafer in the commercial IC foundry, and the ICP process is completely compatible with the IC foundry and is free from the problem of material contamination. Thus, the ink-jet print head of the invention may be manufactured by the commercial IC foundry, which is advantageous to the cost reduction.

In order to implement this invention, the inventors have fabricated some ink-jet print heads and taken some pictures. The real operation states of the ink-jet print head will be described in the following. The chamber sidewall heating mechanism starts to heat the ink. Then, a bubble is generated. Next, the bubble grows larger and larger. Finally, the bubble pushes the ink drop to eject.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An ink-jet print head with a chamber sidewall heating mechanism, the print head comprising:

a substrate;

an insulation layer on the substrate;

a heating unit on the insulation layer, the heating unit having a plurality of ink chambers, a main channel penetrating through the substrate and the insulation layer, and a plurality of V-shaped micro-channels, each of the V-shaped micro-channels having a diverging end linking with the main channel, and a converging end linking with the ink chambers; and a nozzle plate with a plurality of orifices on the ink chambers, wherein the ink chambers have sidewalls formed with a plurality of heater structures, respectively, to evaporate the ink in the ink chambers so as to form a plurality of bubbles, which pushes the ink in the ink chambers to eject from the orifices in an ejecting direction substantially perpendicular to a direction from the diverging end to the converting end, respectively.

2. The ink-jet print head according to claim 1, wherein the heater structures are designed to form virtual valves by the bubbles to isolate the ink in the V-shaped micro-channels from entering the ink chambers, respectively.

3. The ink-jet print head according to claim 1, wherein the heating unit comprises:

a plurality of first silicon structures on the insulation layer;

a plurality of second silicon structures, which is on the insulation layer and adjacent to the first silicon structures, wherein the second silicon structures together with the first silicon structures define the V-shaped micro-channels; and a plurality of third silicon structures, which is located on the insulation layer and has a plurality of first heating resistors connected to the first silicon structures, and a plurality of second heating resistors connected to the second silicon structures, wherein the third silicon structures define the ink chambers.

4. The ink-jet print head according to claim 3, wherein the heating unit further comprises:

a plurality of first metal wires, which is formed on the first silicon structures and has a plurality of first ends electrically connected to a first voltage, and a plurality of second ends adjacent to the first heating resistors;

a plurality of second metal wires, which is formed on the second silicon structures and has a plurality of first ends electrically connected to a second voltage, and a plurality of second ends adjacent to the second heating resistors; and a plurality of third metal wires, which is formed on the third silicon structures and has a plurality of first ends adjacent to the first heating resistor and a plurality of second ends adjacent to the second heating resistors.

5. The ink-jet print head according to claim 4, wherein the third silicon structures have relatively reduced silicon structure widths at necks between the first heating resistors and the second heating resistors, respectively.

6. The ink-jet print head according to claim 4, wherein each of the third silicon structures has a substantially circular ring shape.

7. The ink-jet print head according to claim 4, wherein each of the third silicon structures has a substantially rectangular ring shape.

8. The ink-jet print head according to claim 4, wherein the heating unit is formed with a plurality of heat isolation holes for isolating heat generated by the heater structures from being transferred out.

9. The ink-jet print head according to claim 1, wherein the heating unit has a thickness substantially ranging from 15 to 30 microns.

10. The ink-jet print head according to claim 1, wherein the insulation layer is composed of silicon dioxide and has a thickness substantially ranging from 1 to 3 microns.

11. An ink-jet print head with a chamber sidewall heating mechanism, the print head comprising:

a substrate;

an insulation layer on the substrate;

a heating unit on the insulation layer, the heating unit having a plurality of ink chambers, a main channel penetrating through the substrate and the insulation layer, and a plurality of V-shaped micro-channels, each of the V-shaped micro-channels having a diverging end linking with the main channel, and a converging end linking with the ink chambers; and a nozzle plate with a plurality of orifices on the ink chambers, wherein the ink chambers have sidewalls formed with a plurality of heater structures, respectively, to evaporate the ink in the ink chambers so as to form a plurality of bubbles, which pushes the ink in the ink chambers to eject from the orifices, respectively, wherein the heating unit comprises:

a plurality of first silicon structures on the insulation layer;

a plurality of second silicon structures, which is on the insulation layer and adjacent to the first silicon structures, wherein the second silicon structures together with the first silicon structures define the V-shaped micro-channels; and a plurality of third silicon structures, which is located on the insulation layer and has a plurality of first heating resistors connected to the first silicon structures, and a plurality of second heating resistors connected to the second silicon structures, wherein the third silicon structures define the ink chambers.

12. The ink-jet print head according to claim 11, wherein the heating unit further comprises:

a plurality of first metal wires, which is formed on the first silicon structures and has a plurality of first ends electrically connected to a first voltage, and a plurality of second ends adjacent to the first heating resistors;

a plurality of second metal wires, which is formed on the second silicon structures and has a plurality of first ends electrically connected to a second voltage, and a plurality of second ends adjacent to the second heating resistors; and a plurality of third metal wires, which is formed on the third silicon structures and has a plurality of first ends adjacent to the first heating resistors and a plurality of second ends adjacent to the second heating resistors.

13. The ink-jet print head according to claim 12, wherein the third silicon structures have relatively reduced silicon structure widths at necks between the first heating resistors and the second heating resistors, respectively.

14. The ink-jet print head according to claim 12, wherein each of the third silicon structures has a substantially circular ring shape.

15. The ink-jet print head according to claim 12, wherein each of the third silicon structures has a substantially rectangular ring shape.

16. The ink-jet print head according to claim 12, wherein the heating unit is formed with a plurality of heat isolation holes for isolating heat generated by the heater structures from being transferred out.

* * * * *